US010756480B2

(12) United States Patent
Koyama et al.

(10) Patent No.: US 10,756,480 B2
(45) Date of Patent: Aug. 25, 2020

(54) CONNECTOR AND CONNECTOR ASSEMBLY

(71) Applicant: SMK Corporation, Tokyo (JP)

(72) Inventors: Yuki Koyama, Tokyo (JP); Toshihiko Kato, Kanagawa (JP); Kiyoshi Asai, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/505,752

(22) Filed: Jul. 9, 2019

(65) Prior Publication Data

US 2020/0028299 A1 Jan. 23, 2020

(30) Foreign Application Priority Data

Jul. 17, 2018 (JP) ..... 2018-134152

(51) Int. Cl.
*H01R 11/30* (2006.01)
*H01R 13/62* (2006.01)
*H01R 13/639* (2006.01)

(52) U.S. Cl.
CPC ..... *H01R 13/6205* (2013.01); *H01R 13/639* (2013.01)

(58) Field of Classification Search
CPC ..... H01R 13/6205; H01R 13/639
USPC ..... 439/38, 39
See application file for complete search history.

(56) References Cited

U.S. PATENT DOCUMENTS 3,810,258 A * 5/1974 Mathauser ..... H01R 13/6205 439/39
4,112,941 A * 9/1978 Larimore ..... A61B 5/0416 600/394
4,317,969 A * 3/1982 Riegler ..... H01R 13/6205 200/52 R
5,784,511 A * 7/1998 Kikuchi ..... G02B 6/3886 385/53
10,594,074 B1 * 3/2020 Zhao ..... H01R 12/775

FOREIGN PATENT DOCUMENTS

JP 2016048614 A 4/2016

* cited by examiner

*Primary Examiner* — Khiem M Nguyen

(57) ABSTRACT

A connector and a connector assembly capable of being attached to a freely bendable object such as clothes when used are provided. A connector is attached to a predetermined object such as a clothes and capable of being detachably fitted into a counterpart connector The connector includes: a plate-shaped housing made of an insulating material having bendability; a retention member provided in the housing so as to allow for the bendability, the retention member being configured to retain a fit state with the counterpart connector; a flexible sheet attached to the housing in such a manner as to cover at least a part of the retention member and attached to the object by attaching material; and a conductive contact provided on the sheet.

7 Claims, 16 Drawing Sheets

CONNECTOR AND CONNECTOR ASSEMBLY

CROSS REFERENCE TO RELATED APPLICATION

The contents of the following Japanese patent application are incorporated herein by reference, Japanese Patent Application No. 2018-134152 filed on Jul. 17, 2018.

FIELD

The present invention relates to a connector and a connector assembly.

BACKGROUND

There has been known a configuration for achieving a fit between a connector (receptacle) and a counterpart connector (plug) by means of mutual attraction therebetween under the influence of magnetic force. Specifically, the connector includes a magnetic metal member, and the counterpart connector includes a magnet. The magnetic metal member and the magnet are attracted to each other, thereby retaining the fit state (see Patent Literature 1, for example).

Patent Literature 1 discloses a connector that retains a fit state with a counterpart connector by means of magnetic force. This connector includes a plurality of contacts and a magnetic metal member in a housing. The counterpart connector includes a plurality of contacts and a magnet in a shell accommodated in a housing. Upon the fit between the connector and the counterpart connector, their contacts are in contact with each other, and the magnet in the counterpart connector and the magnetic metal member in the connector are attracted to each other by the magnetic force. This allows the fit state to be retained.

CITATION LIST

Patent Literature

Patent Literature 1: Japanese Patent Application Laid-Open No 2016-048614

SUMMARY

Technical Problem

In the related connector described in Patent Literature 1, however, the magnetic metal member having high stiffness is disposed over the entire fitting surface of the connector in addition to the high stiffness of the housing itself. Thus, it is difficult to attach the connector to a freely bendable object, such as clothes. If the connector were attached to such an object, the connector would not be able to follow the bending of the object, possibly resulting in the dropping off of the connector from the object, the breakage of the object by the connector, or giving a sense of discomfort to a wearer, for example.

The present invention has been made to solve the problems as mentioned above. It is an object of the present invention to provide a connector and a connector assembly capable of being attached to a freely bendable object such as clothes when used.

Solution to Problem

In order to achieve the aforementioned object, a connector of an aspect of the present invention is (1) a connector attached to a predetermined object and capable of being detachably fitted into a counterpart connector, including: a plate-shaped housing made of an insulating material having bendability; a retention member provided in the housing so as to allow for the bendability, the retention member being configured to retain a fit state with the counterpart connector; a flexible sheet attached to the housing in such a manner as to cover at least a part of the retention member and attached to the object by attaching material; and a conductive contact provided on the sheet.

With such a configuration, even when an attachment object is a freely bendable object such as clothes, the connector of the aspect of the present invention allows, due to its bendable housing, the sheet to be reliably and easily attached to the object by the attaching material such as sewing or bonding. Moreover, after the attachment of the connector, the dropping off of the connector, the breakage of the object, or giving a sense of discomfort to a user, for example, is less likely to occur. The connector of the aspect of the present invention can therefore present a solution to the task of making it possible to attach the connector to a freely bendable object such as clothes and use the connector.

Moreover, according to the connector of the aspect of the present invention, the provision of the contact can be facilitated by providing the contact on the sheet to be attached to the housing, and the connector structure can be simplified by allowing electric contact with the counterpart connector to be obtained only in the sheet. Moreover, since the sheet is attached to the housing while covering the part of the retention member, the connector of the aspect of the present invention can prevent the retention member from dropping off from the housing. This allows a reliable conduction state with the counterpart connector to be retained.

According to the aspect of the connector of the present invention, (2) the contact is formed in a strip shape as a coating layer of a conductive ink on a front surface of the sheet, and the contact is provided on one of plate surfaces of the housing and the other one of the plate surfaces by folding the sheet with an intermediate portion of the contact being used as a bending portion in such a manner that rear surface portions, opposite to the front surface, face each other.

According to such a configuration of the aspect of the connector of the present invention, the contact can be easily provided on both of the one of the plate surfaces of the housing and the other one of the plate surfaces by forming the contact only on the front surface of the sheet.

Consequently, the time and effort to form the contact for the housing can be reduced, thereby improving the productivity of the connector.

According to the connector of the aspect of the present invention, (3) the sheet is attached to the housing while being folded in such a manner as to enwrap the housing.

According to such a configuration of the connector of the aspect of the present invention, the housing is protected by the sheet, and the dropping off of the retention member from the housing or the dropping off of the housing from the object when the connector is attached to the object can be reliably prevented from occurring.

According to the connector of the aspect of the present invention, (4) the sheet includes a housing recess configured to contain the housing therein, and the sheet is attached to the housing with the housing being contained in the housing recess.

According to such a configuration of the connector of the aspect of the present invention, the positioning of the housing relative to the sheet can be facilitated by placing the housing in the housing recess. Consequently, the housing can be easily attached to the sheet, thereby improving the productivity of the connector.

According to the connector of the aspect of the present invention, (5) the sheet includes a flange around the housing when the sheet is attached to the housing, at least a part of the contact is provided in the flange, and the sheet is attached to the object via the flange by means of the attaching material.

According to such a configuration of the connector of the aspect of the present invention, since the flange of the sheet can be utilized as an allowance used for attaching the connector to the object, the connector can be easily attached to the object.

According to the connector of the aspect of the present invention, (6) the attaching material is a sewing thread.

With such a configuration, when the object is clothes, for example, the connector of the aspect of the present invention can be easily attached to such an object. Moreover, since the sheet has a relatively small thickness as compared to when the connector is sewn including the housing, a general-purpose sewing machine can be used without using a sewing machine designed specifically for sewing a thick object. Thus, the connector can be produced at low cost.

A connector assembly of an aspect of the present invention is (7) a connector assembly including: the above-described connector the aspect of the present invention; and a counterpart connector into which the connector is fitted. The counterpart connector includes: a counterpart housing; a conductive counterpart contact provided in the counterpart housing; and a counterpart retention member provided in the counterpart housing and including a magnet. Upon a fit between the connector and the counterpart connector, the contact and the counterpart contact are in contact with each other, and the retention member and the counterpart retention member are attracted to each other by magnetic force, thereby retaining the fit state.

According to such a configuration of the connector assembly of the aspect of the present invention, the connector assembly including the connector capable of being attached to a freely bendable object such as clothes when used can be provided.

According to the aspects of present invention, the connector and the connector assembly capable of being attached to a freely bendable object such as clothes when used can be provided.

DESCRIPTION OF EMBODIMENTS

Figure 1A:
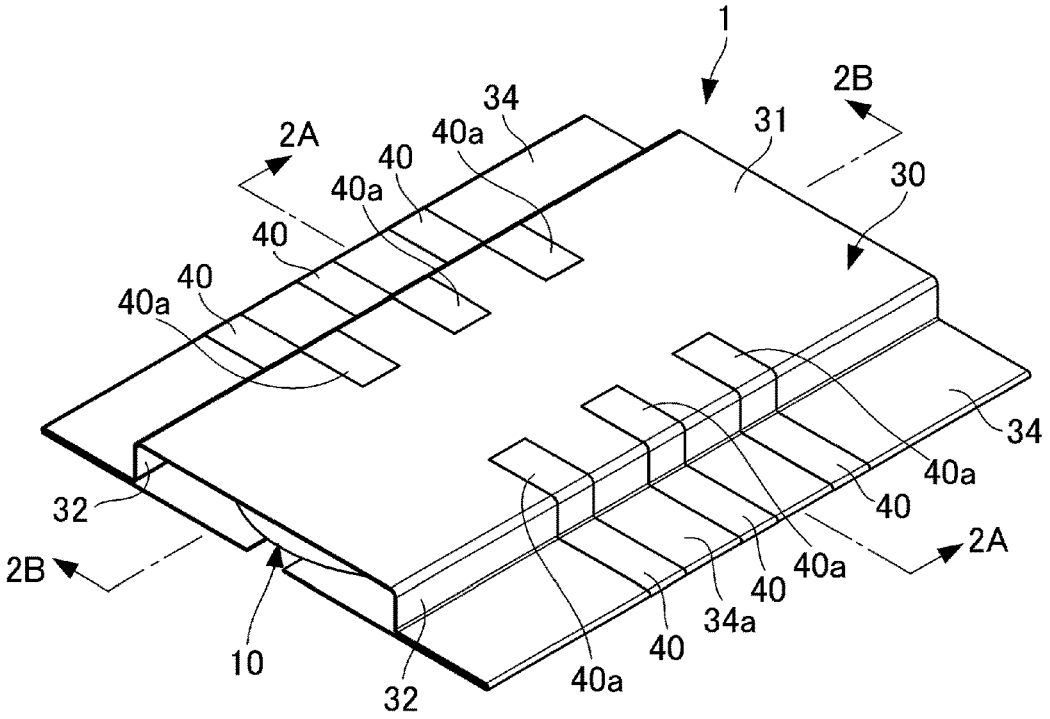
FIG. 1A is a perspective view showing a front surface side of a connector according to a first embodiment of the present invention.

Connectors and connector assemblies according to embodiments of the present invention will be described below with reference to the drawings.

First Embodiment

A configuration of the first embodiment will be described first.

As shown in FIGS. 1A, 1B, 2A and 2B, a connector 1 according to the first embodiment of the present invention includes: a plate-shaped housing 10 made of an insulating material having bendability; four retention members 20 made of a magnetic material and provided in the housing 10 so as to allow for the bendability of the housing 10; a flexible sheet 30 attached to the housing 10 in such a manner as to cover the housing 10; and conductive contacts 40 provided on the sheet 30.

Figure 1B:
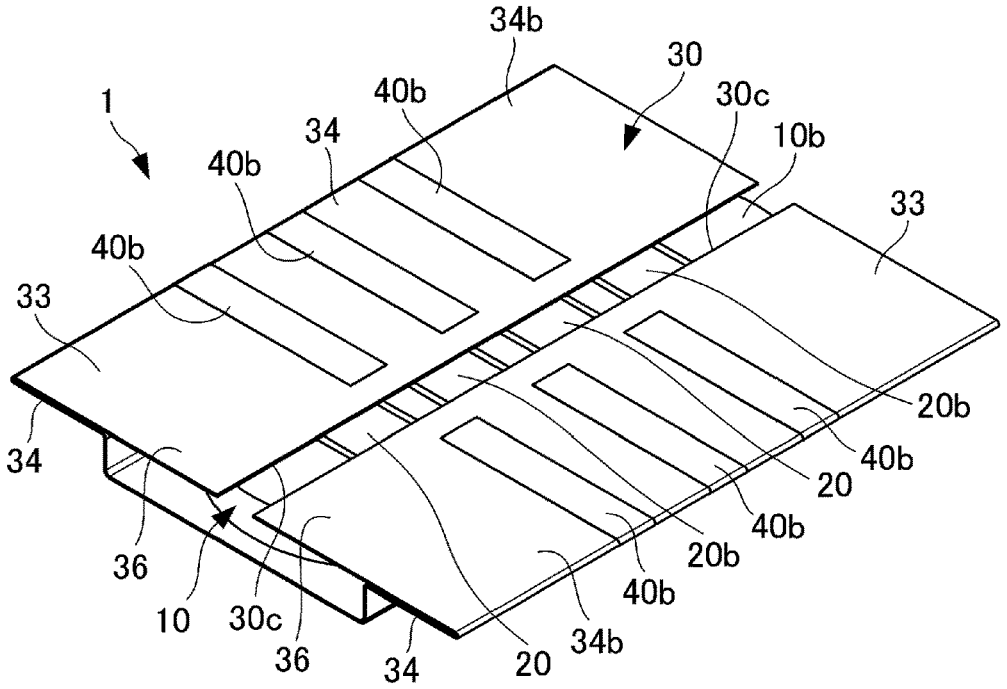
FIG. 1B is a perspective view showing a rear surface side of the connector according to the first embodiment of the present invention.
Figure 3A:
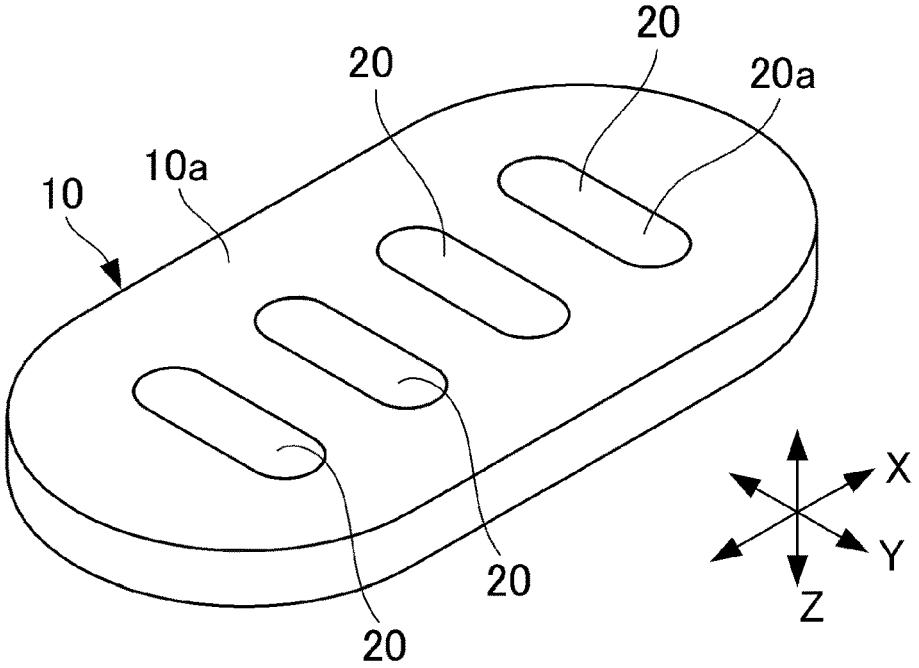
FIG. 3A is a perspective view showing a front surface side of a housing according to the first embodiment.
Figure 3B:
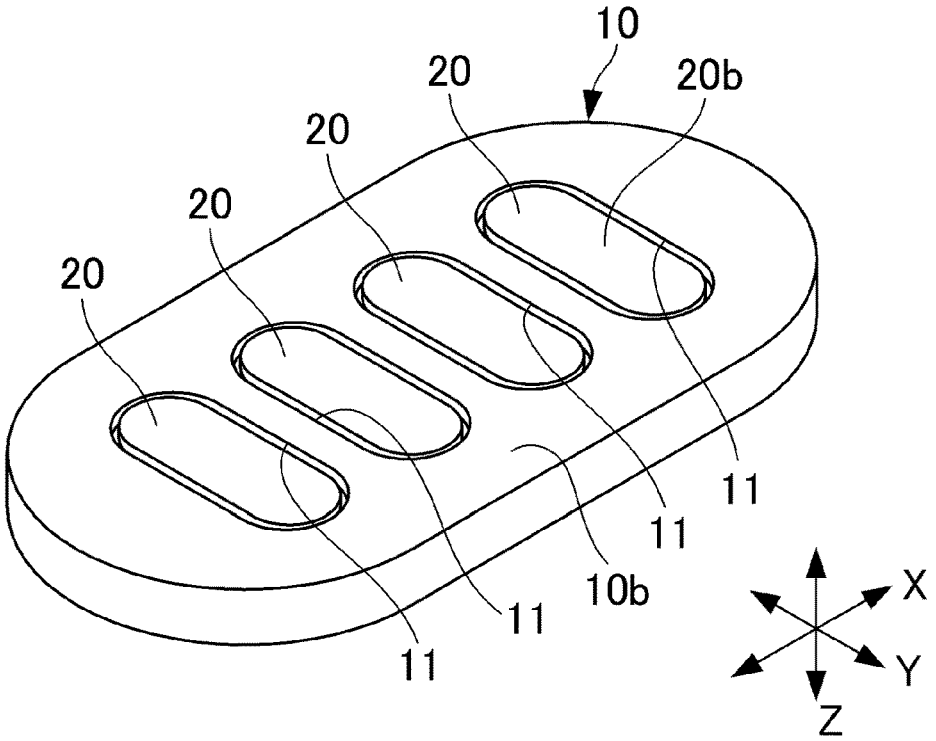
FIG. 3B is a perspective view showing a rear surface side of the housing according to the first embodiment.
Figure 4:
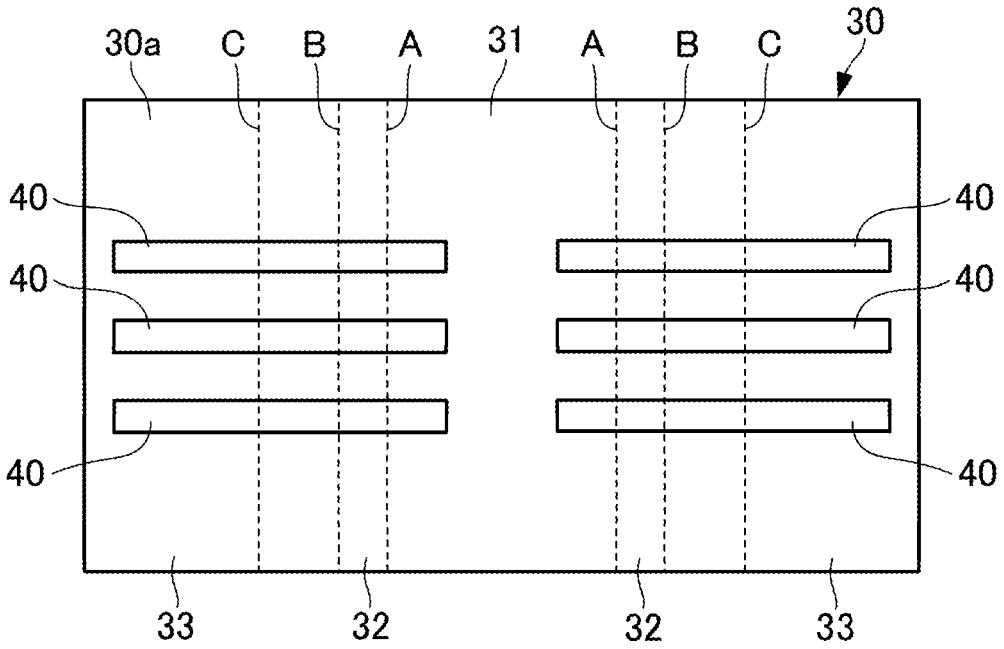
FIG. 4 is a plan view showing a sheet of the first embodiment in an unfolded state.

FIG. 3 shows the housing 10 provided with the four retention members 20, and FIG. 4 shows the flat sheet 30 to be attached to the housing 10. As shown in FIGS. 1A and 1B, the sheet 30 is attached to the housing 10 while being folded in such a manner as to enwrap the housing 10. The thus attached sheet 30 covers a large part of the housing 10 and the retention members 20. When the connector 1 is fitted into a counterpart connector 9, the retention members 20 serve to retain the fit state by magnetic force as will be described later.

Figure 5A:
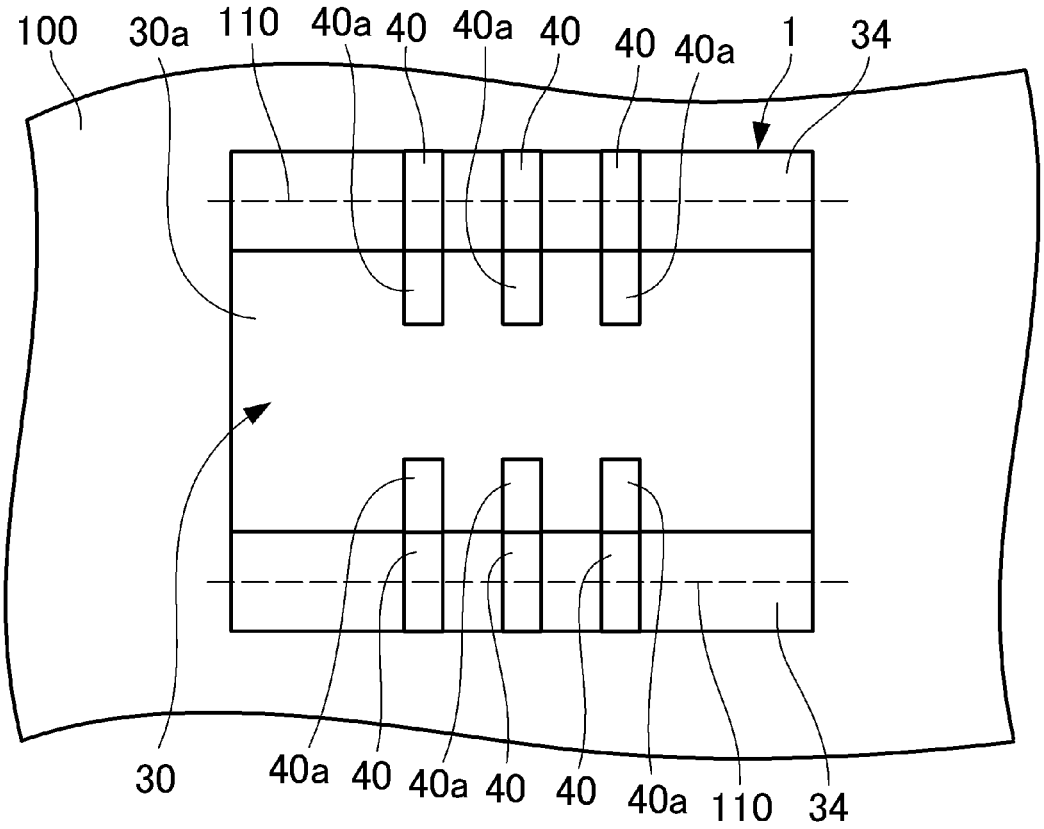
FIG. 5A is a view showing a state in which the connector of the first embodiment is attached to clothes.
Figure 5B:
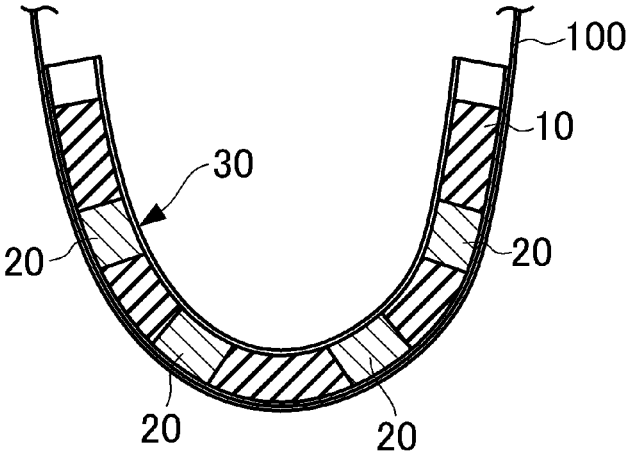
FIG. 5B is a cross-sectional view of the connector of the first embodiment being bent with the clothes.

As shown in FIGS. 5A and 5B, the connector 1 of the present embodiment is sewn on clothes 100 with an insulating sewing thread 110 when used. Sewn onto the clothes 100 is the sheet 30. The clothes 100 correspond to an exemplary object of the present invention, and the sewing thread 110 corresponds to exemplary attaching material of the present invention.

A conductive pattern (not shown) is provided on the clothes 100 with a conductive ink, for example. The conductive pattern of the clothes 100 is electrically connected to the contacts 40 of the connector 1 sewn onto the clothes 100. Thus, when the connector 1 sewn onto the clothes 100 is fitted into the counterpart connector 9, the conductive pattern of the clothes 100 connected to the connector 1 and an electric wire 96 connected to the counterpart connector 9 become electrically connected to each other.

In the present embodiment, the connector 1 is sewn onto the clothes 100 with the sewing thread 110. Note that the connector 1 may be attached to the clothes 100 with an adhesive or by means of both attachment with an adhesive and sewing. In either case, the connector 1 is configured in such a manner that the sheet 30 can be attached to the clothes 100.

While the connector 1 is a receptacle and the counterpart connector 9 is a plug in the present embodiment, the present invention is not limited thereto. The connector 1 may be a plug, and the counterpart connector 9 may be a receptacle.

The housing 10, the retention members 20, and the sheet 30 constituting the connector 1 will be described below.

As shown in FIGS. 3A and 3B, the housing 10 of the embodiment of the present invention is made of a plate-shaped insulating material having bendability, such as rubber or elastomer, for example. The housing 10 has a track shape with both ends of the plate in a longitudinal direction thereof (the X direction in FIGS. 3A and 3B) having an arc shape. Such a shape prevents the damage or breakage of the clothes 100 by the housing 10 when the connector 1 is attached to the clothes 100.

The housing 10 includes four through holes 11 for installing the four retention members 20 in the housing 10, which are provided to pass through the housing 10 from its front surface 10*a* to its rear surface 10*b* in a thickness direction thereof (the Z direction in FIGS. 3A and 3B). The front surface 10*a* corresponds to one of exemplary plate surfaces of the present invention, and the rear surface 10*b* corresponds to the other one of the exemplary plate surfaces of the present invention.

Figure 2A:
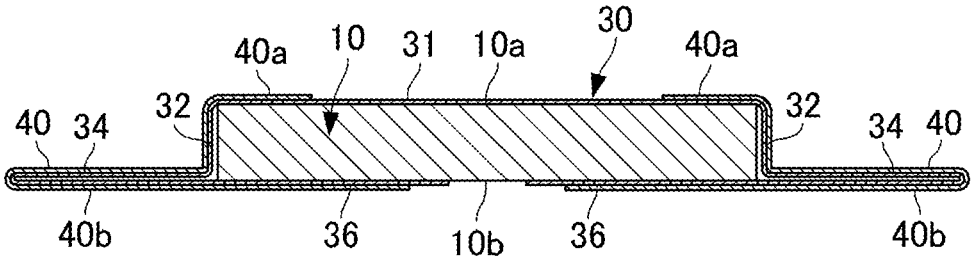
FIG. 2A is a cross-sectional view taken along line 2A-2A in FIG. 1A.
Figure 2B:
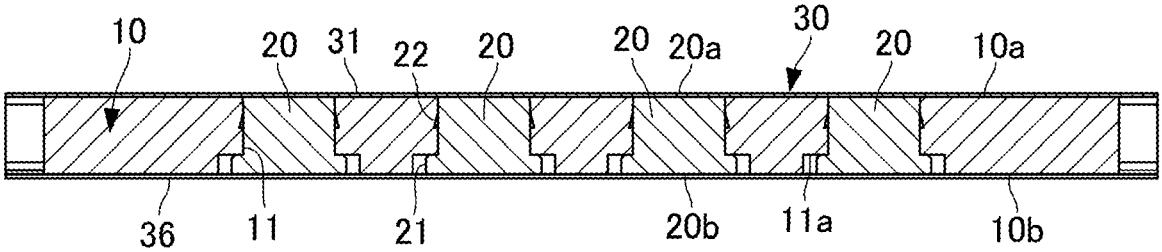
FIG. 2B is a cross-sectional view taken along line 2B-2B in FIG. 1A.

The through holes 11 each have a shape in conformity with a shape of the retention member 20 and extend in a plate width direction (the Y direction in FIGS. 3A and 3B) of the housing 10. The through holes 11 are provided at equally-spaced intervals along the longitudinal direction at a center in the plate width direction of the housing 10. As shown in FIG. 2B, a countersunk step portion 11*a* is provided around an opening of each of the through holes 11 in the rear surface 10*b* of the housing 10. The four retention members 20 are provided in the housing 10 with the retention members 20 being fitted into the through holes 11.

The housing 10 of the present embodiment is the plate-shaped member with the both ends thereof having an arc shape. The shape of the housing 10, however, is not limited thereto. Any shape such as a circular, elliptical, or rectangular shape in a planar view may be employed. Note however that a nonangular shape is preferably used in order to avoid damage on the clothes 100.

The retention member 20 of the embodiment of the present invention is made of, for example, a magnetic metal having a magnetic property, such as stainless steel. When the connector 1 is fitted into the counterpart connector 9, the retention members 20 retain the fit state by being attracted to a magnet 92*a* included in the counterpart connector 9. The retention members 20 have stiffness higher than that of the housing 10 and have a function to keep the form of the connector 1.

The retention member 20 has an elongated plate shape with its both ends in a longitudinal direction thereof having an arc shape. As shown in FIG. 2B, the retention member 20 has a ring-shaped protruding portion 21 at its one end in a thickness direction thereof. The retention member 20 also includes a ring-shaped protrusion 22 provided approximately in the middle portion of its side circumferential surface in such a manner as to bulge out obliquely in an outspread manner toward the ring-shaped protruding portion 21.

As shown in FIG. 2B, the retention members 20 are fitted into the through holes 11 of the housing 10. In order to fit the retention member 20 into the through hole 11, an end of the retention member 20 opposite to the ring-shaped protruding portion 21 in the thickness direction thereof is inserted first into the through hole 11 from the rear surface 10*b* side of the housing 10 in which the step portion 11*a* is provided. The ring-shaped protruding portion 21 is then brought into abutment with the step portion 11*a*. In this fit state, a front surface-side end face 20*a* of the retention member 20 is approximately in the same plane with the front surface 10*a* of the housing 10 so as to be exposed from the front surface 10*a*. A rear surface-side end face 20*b* of the retention member 20, on the other hand, is approximately in the same plane with the rear surface 10*b* of the housing 10 so as to be exposed from the rear surface 10*b*.

The abutment of the ring-shaped protruding portion 21 against the step portion 11*a* prevents the retention member 20 from coming off from the front surface 10*a* side of the housing 10, and engagement of the ring-shaped protrusion 22 with an inner periphery of the through hole 11 can prevent the retention member 20 from coming off from the rear surface 10*b* side of the housing 10.

The retention member 20 is a magnetic metal in the present embodiment. The retention member 20, however, is not limited thereto but may be a magnet. Moreover, the front surface-side end face 20*a* of the retention member 20 is exposed from the front surface 10*a* of the housing 10 in the present embodiment. The retention member 20, however, is not limited thereto but may be buried in the housing 10, i.e., in the through hole 11. Furthermore, the number of the retention members 20 is not limited to four. Any number of retention members 20 greater than or equal to two may be provided.

While the retention members 20 are arranged in a row along the longitudinal direction of the housing 10 in the present embodiment, the retention members 20 may be arranged in two or more rows. For example, a plurality of retention members 20 may be arranged in a plurality of rows in such a manner as to be separated from one another in the X direction in FIGS. 3A and 3B and also separated from one another in the Y direction. While the plurality of retention members 20 are arranged at equally-spaced intervals in the present embodiment, the retention members 20 may be provided at different intervals.

FIG. 4 shows the sheet 30 of the present embodiment in an unfolded state. As shown in FIG. 4, the sheet 30 is formed in a rectangular shape. The sheet 30 is obtained, for example, by cutting or punching thin rubber, a stretch fabric, or a sheet-like resin material such as nylon. When the sheet 30 is made of a resin, TPU (thermoplastic polyurethane), among others, having both pliant elasticity like rubber and a strength like rigid plastic is preferably used. When the sheet 30 is made of TPU, a thickness of the sheet 30 is preferably in a range of about 0.1 to 0.5 mm, for example. A material through which the sewing thread 110 can pass so as to sew the sheet 30 onto the clothes 100 is selected as a material for the sheet 30 of the present embodiment.

The sheet 30 of the present embodiment is folded into a thin rectangular solid shape as shown in FIGS. 1A and 1B with a broken line A shown in FIG. 4 being used as a right-angled mountain fold portion, a broken line B as a right-angled valley fold portion, and a broken line C as a bending portion at which the sheet 30 is folded back 180 degrees.

The sheet 30 includes a front surface covering portion 31 for covering the front surface 10*a* of the housing 10 between the two mountain fold portions A and A. The sheet 30 also includes a side surface covering portion 32 on each side of the front surface covering portion 31. The sheet 30 also includes flange-forming portions 33 next to the sides of the side surface covering portions 32. By folding the sheet 30 with the housing 10 being disposed on the back of the front surface covering portion 31, the sheet 30 is attached to the housing 10 while covering the housing 10. The housing 10 is disposed in such a manner that the front surface 10*a* thereof faces the front surface covering portion 31 of the sheet 30.

As shown in FIG. 4, a front surface 30*a* of the sheet 30 is provided with the six strip-shaped contacts 40. These contacts 40 are arranged in threes symmetrically in a horizontal direction in FIG. 4 in two regions extending from the front surface covering portion 31 to the flange-forming portions 33. Each of the contacts 40 is provided to extend in the horizontal direction in FIG. 4 while crossing, at a right angle, the mountain fold portion A, the valley fold portion B, and the bending portion C. The contacts 40 are arranged at equally-spaced intervals in a vertical direction in FIG. 4 in a central portion in the vertical direction. Each of the contacts 40 formed as a coating layer of a conductive ink is provided to have a thickness of 30 to 50 μm, for example.

The sheet 30 is kept attached to the housing 10 by being bonded to the housing 10 with an adhesive or by sewing the sheet 30 into a bag-like shape and placing the housing 10 therein. Alternatively, the housing 10 may be held by the sheet 30 and the clothes 100 by sewing the sheet 30 onto the clothes 100 with the housing 10 being interposed between the sheet 30 and the clothes 100 when the sheet 30 is sewn onto the clothes 100 as shown in FIGS. 5A and 5B.

As shown in FIGS. 1A and 1B, the sheet 30 attached to the housing 10 has a flange 34 on each side of the housing 10. These flanges 34 are each formed by folding back the flange-forming portion 33 of the sheet 30 180 degrees along the bending portion C.

As shown in FIG. 1B, edges 30*c* at the both ends of the sheet 30 are disposed on the rear surface 10*b* side of the housing 10. These edges 30*c* at the both ends of the sheet 30 are separated from each other at the center of the housing 10 in the plate width direction to form a gap therebetween, and parts of the rear surface-side end faces 20*b* of the retention members 20 are exposed from the gap.

The front surface-side end faces 20*a* of the retention members 20 are completely covered with the sheet 30. As shown in FIG. 1B, both end portions of the rear surface-side end faces 20*b* of the retention members 20, excluding their central portions, are covered with rear surface covering portions 36 in both end portions of the sheet 30.

In the state in which the sheet 30 is attached to the housing 10 while covering the housing 10 as shown in FIGS. 1A and 1B, each of the contacts 40 is provided to extend over a region from the front surface covering portion 31, through the side surface covering portion 32 and a front surface 34*a* of the flange 34, to a rear surface 34*b* of the flange 34 opposite to the front surface 34*a*. In other words, each of the contacts 40 formed on the front surface 30*a* of the sheet 30 is provided on the front surface 10*a* side and the rear surface 10*b* side of the housing 10 by folding the sheet 30 (an intermediate portion of each contact 40) along the bending portion C in such a manner that rear surface portions of the sheet 30 face each other.

In the present embodiment, a portion of the contact 40 provided in the front surface covering portion 31 for covering the front surface 10*a* of the housing 10 constitutes a front-side contact portion 40*a* to be in contact with a counterpart contact 94 of the counterpart connector 9. A portion of the contact 40 provided on the rear surface 10*b* side of the housing 10 constitutes a rear-side contact portion 40*b* to be in contact with the conductive pattern of the clothes 100.

The counterpart connector 9 into which the connector 1 is fitted will be described next.

Figure 6A:
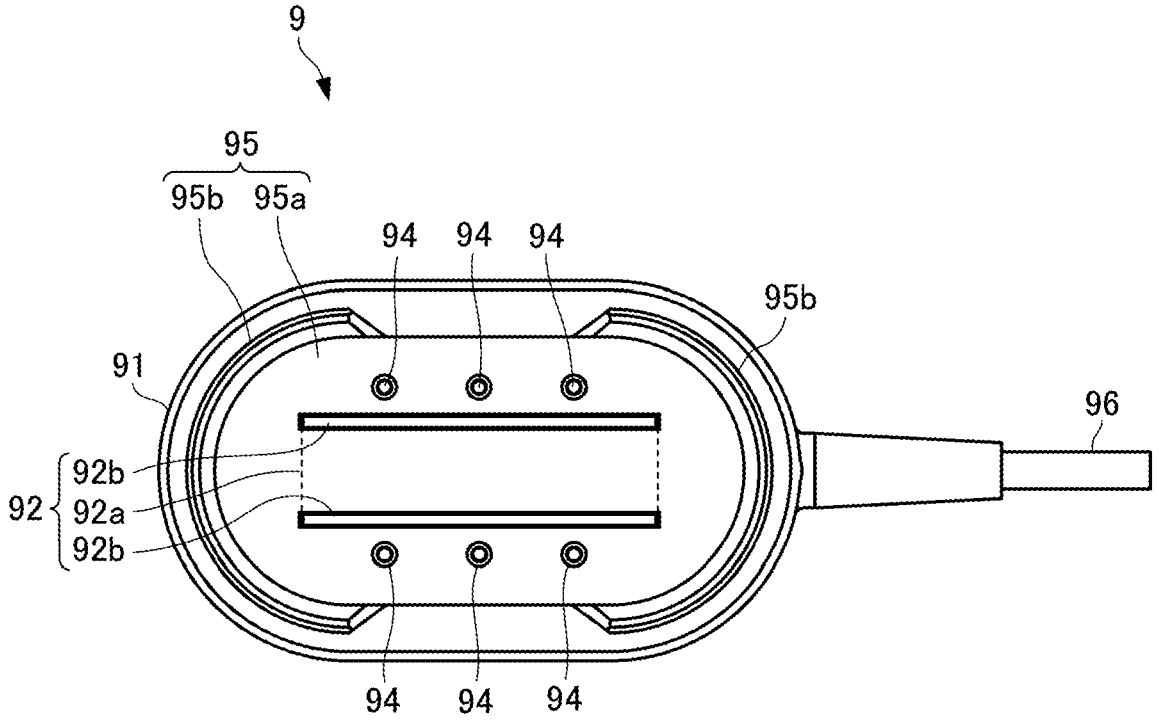
FIG. 6A is a plan view of a counterpart connector according to the first embodiment.
Figure 6B:
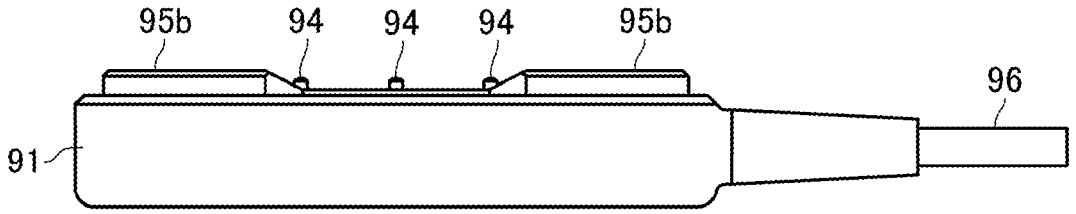
FIG. 6B is a side view of the counterpart connector according to the first embodiment.
Figure 7:
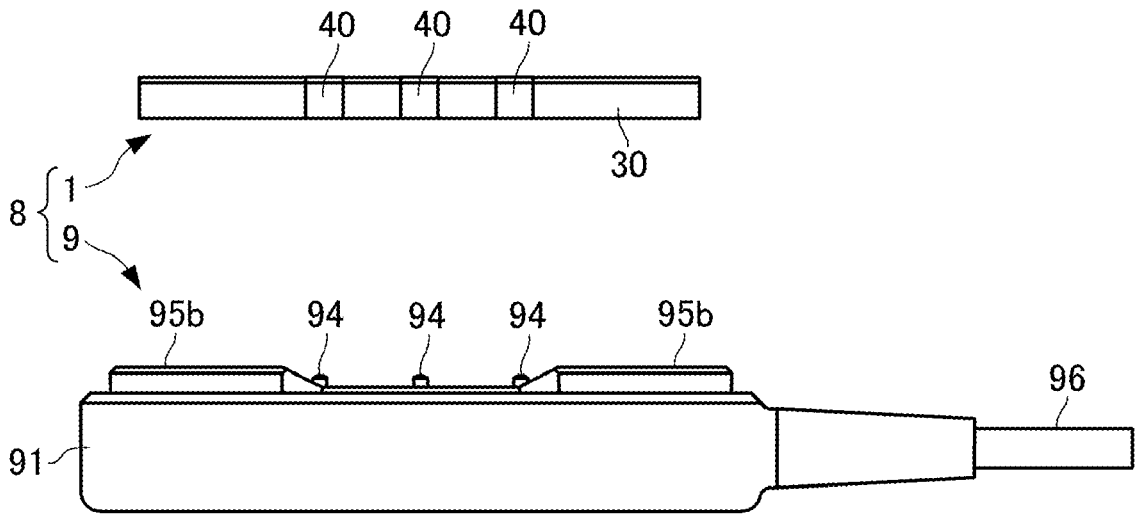
FIG. 7 is a side view of a connector assembly according to the first embodiment, showing a detached state between the connector and the counterpart connector.

As shown in FIGS. 6A, 6B and 7, the counterpart connector 9 includes: a counterpart housing 91; a counterpart retention member 92 provided in the counterpart housing 91 and including the magnet 92*a*; conductive counterpart contacts 94 provided in the counterpart housing 91; and a shell 95. When the connector 1 is fitted into the counterpart connector 9, the retention members 20 of the connector 1 and the counterpart retention member 92 of the counterpart connector 9 are attracted to each other by magnetic force, thereby retaining the fit state between the connector 1 and the counterpart connector 9.

The counterpart housing 91 is a container made of an insulating material such as an insulating resin. An upper surface side of the counterpart housing 91 is opened in FIG. 6B. A substrate (not shown) is contained in the counterpart housing 91, and the six counterpart contacts 94 are provided on the substrate.

The counterpart contact 94 is formed as a pogo pin into which a spring is incorporated so as to be capable of being elastically in contact with the front-side contact portion 40*a* of the contact 40 of the connector 1. The counterpart contacts 94 are arranged in two rows (each row having three counterpart contacts 94) so as to be connected to the front-side contact portions 40*a* of the connector 1 when the connector 1 is fitted into the counterpart connector 9. The counterpart contacts 94 are electrically connected to the electric wire 96 via wiring provided on the above-described substrate.

As shown in FIG. 6A, the counterpart retention member 92 includes: the magnet 92*a* having a rectangular solid shape; and yokes 92*b* made of, for example, magnetic stainless steel and attached to both sides of the magnet 92*a*. The yokes 92*b* slightly protrude from an upper surface of the magnet 92*a*, thereby protecting the magnet 92*a*. The yokes 92*b* also have a function to enhance the magnetic force of the magnet 92*a*. The counterpart retention member 92, being attached on the substrate, is contained in the counterpart housing 91.

The shell 95 is made of an insulating material. As shown in FIGS. 6A, 6B and 7, the shell 95 includes a bottom plate portion 95*a*, and guiding portions 95*b* provided at both ends of the bottom plate portion 95*a*. The bottom plate portion 95*a* in a planar view has a shape approximately the same as that of the housing 10 of the connector 1. The guiding portion 95*b* is curved in a semicircular arc shape in a planar view, and an inner surface of the guiding portion 95*b* is formed as an inclined surface that gradually outspreads toward an upper side in FIG. 6B. The aforementioned yokes 92*b* and counterpart contacts 94 pass through the bottom plate portion 95*a* to protrude from the bottom plate portion 95*a*.

The connector 1 and the counterpart connector 9 achieve a fit state by placing the front surface 10*a* side of the housing 10 on the top of the bottom plate portion 95*a* of the counterpart connector 9 and then aligning the semicircular arc-shaped edges of the both ends of the housing 10 with the inner side of the guiding portions 95*b* on the both sides. When the connector 1 is fitted into the counterpart connector 9, the guiding of the housing 10 by the guiding portions 95*b* of the shell 95 can facilitate such a fit.

A connector assembly 8 shown in FIG. 7 will be described next.

As shown in FIG. 7, the connector assembly 8 includes the connector 1 and the counterpart connector 9 into which the connector 1 is detachably fitted. A portion of the housing 10 corresponding to a predetermined thickness from the front surface 10*a* and the sheet 30 covering that portion in the connector 1 are fitted into the counterpart connector 9. When the connector 1 is fitted into the counterpart connector 9, the sheet 30 is deformed by being bent so as to conform to the housing 10, thereby not disturbing the fit of the housing 10 into the counterpart connector 9.

In the fit state between the connector 1 and the counterpart connector 9, each of the front-side contact portions 40*a* of the contacts 40 in the connector 1 is in contact with corresponding one of the counterpart contacts 94 in the counterpart connector 9. Moreover, the retention members 20 in the connector 1 are arranged so as to extend across the two yokes 92*b* in the counterpart connector 9. In other words, the magnet 92*a* and the yokes 92*b* in the counterpart connector 9 and the retention members 20 of the connector 1 form a single closed magnetic circuit. This magnetic circuit allows the retention members 20 to be strongly attracted to the magnet 92*a* and the yokes 92*b*.

Effects will be described next.

As shown in FIG. 5B, the connector 1 of the present embodiment is used with the flanges 34 of the sheet 30 being sewn onto the clothes 100 with the insulating sewing threads 110. The connector 1 is sewn onto the clothes 100 so that the rear-side contact portions 40*b* of the contacts 40 are in contact with the conductive pattern of the clothes 100.

The four retention members 20 provided in the housing 10 of the connector 1 extend in the plate width direction of the housing 10 and are provided to be separated from each other at predetermined intervals in the longitudinal direction of the housing 10. This allows the housing 10 of the connector 1 to be freely bent at least in such a manner that the both ends of the housing 10 in the longitudinal direction become closer to each other as shown in FIG. 5B. In other words, no retention members 20 become an obstacle to the bending of the housing 10. Moreover, since the sheet 30 has flexibility, the sheet 30 can bend in keeping with the housing 10 without becoming an obstacle to the bending of the housing 10.

Once the counterpart connector 9 is fitted in the connector 1 and the counterpart connector 9 is supplied with electricity through the electric wire 96, the electricity is supplied from the counterpart contacts 94, via the front-side contact portions 40*a* and the rear-side contact portions 40*b* of the connector 1, to the conductive pattern of the clothes 100. The counterpart connector 9 can be removed from the connector 1 by pulling apart the counterpart connector 9 from the connector 1 with a force stronger than the magnetic force by which the counterpart retention member 92 is attracted to the retention members 20.

According to the connector 1 of the present embodiment, since the housing 10 is bendable, the sheet 30 can be reliably and easily attached to the freely bendable clothes 100 by the attaching material, such as sewing or bonding. Moreover, in the connector 1, the housing 10 has bendability, the both ends of the housing 10 in the longitudinal direction are formed in an arc shape, and the housing 10 is covered with the sheet 30. Thus, the connector 1 during use prevents the damage or breakage of the clothes 100 and gives no sense of discomfort to a user.

Moreover, the connector 1 of the present embodiment can facilitate the provision of the contacts 40 by providing the contacts 40 on the sheet 30 to be attached to the housing 10. The connector 1 can make electric contact with the counterpart connector 9 only in the sheet 30, thus making it possible to simplify the connector structure.

Moreover, since the sheet 30 is attached to the housing 10 while being folded in such a manner as to enwrap the housing 10 and covering the large part of the retention members 20, the connector 1 can prevent the retention members 20 from dropping off from the housing 10. At the same time, the connector 1 can retain a reliable conduction state with the counterpart connector 9. Moreover, the housing 10 is protected by the sheet 30, and the housing 10 can be reliably prevented from dropping off from the clothes 100.

Moreover, according to the connector 1 of the present embodiment, the contacts 40 can be provided separately as the front-side contact portions 40*a* and the rear-side contact portions 40*b* by forming the contacts 40 only on the front surface 30*a* of the sheet 30 and then folding the sheet 30. Thus, the contacts 40 can be easily provided on both of the front surface 10*a* side and the rear surface 10*b* side of the housing 10. Consequently, the time and effort to form the contacts 40 can be reduced, thereby improving the productivity of the connector 1.

Moreover, the connector 1 of the present embodiment can be attached to the clothes 100 by sewing the sheet 30 onto the clothes 100 with the sewing thread 110. Thus, the connector 1 can be easily attached to the clothes 100. Moreover, since the sheet 30 has a relatively small thickness as compared to when the connector 1 is sewn including the housing 10, a general-purpose sewing machine can be used without using a sewing machine designed specifically for sewing a thick object. Thus, the connector 1 can be produced at low cost.

Moreover, since the connector 1 of the present embodiment can be sewn onto the clothes 100 with the use of the flanges 34 of the sheet 30 as a seam allowance, the connector 1 can be easily attached to the clothes 100. Moreover, since the contact 40 is formed as the coating layer of the conductive ink, there is no need to sew the sheet 30 while avoiding the contacts 40. The sheet 30 can be sewn in such a manner that its seam runs over the contacts 40. Also in this respect, the connector 1 can be easily attached to the clothes 100.

Second Embodiment

The second embodiment will be described next.

The second embodiment is configured in such a manner that a sheet 50 is attached to a housing 10 instead of the aforementioned sheet 30 of the first embodiment. The housing 10 and retention members 20 in the second embodiment are identical to those of the first embodiment. Therefore, the sheet 50 will be mainly described in the following description. Note that the same components as those of the first embodiment will be denoted by the same reference numerals in the reference drawings and the description thereof will be omitted as appropriate.

Figure 8A:
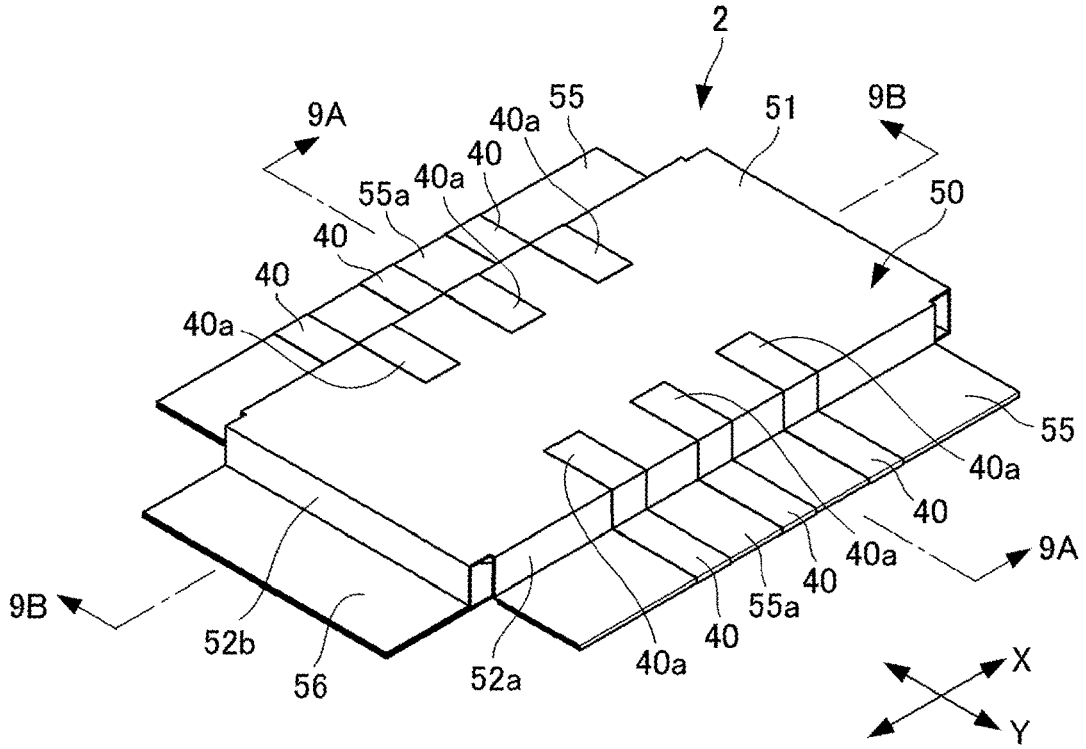
FIG. 8A is a perspective view showing a front surface side of a connector according to a second embodiment.
Figure 8B:
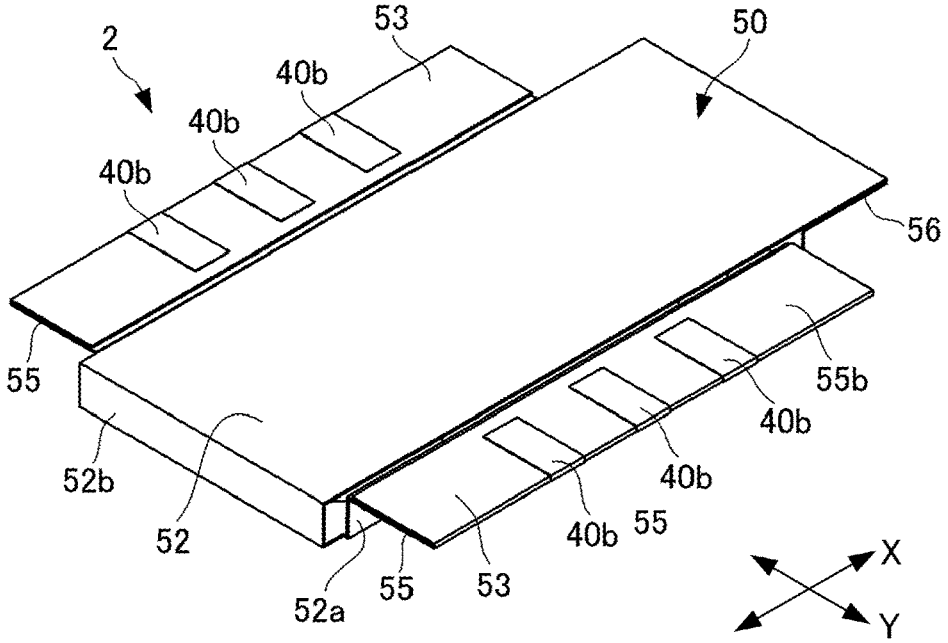
FIG. 8B is a perspective view showing a rear surface side of the connector according to the second embodiment.
Figure 9A:
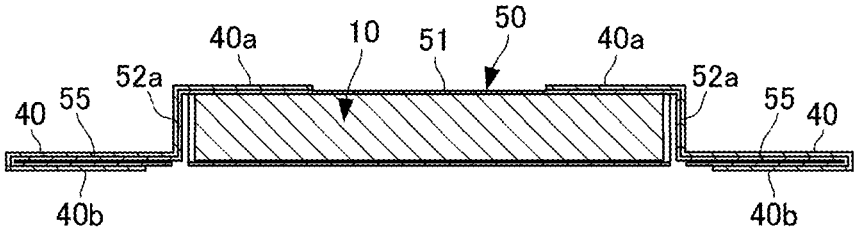
FIG. 9A is a cross-sectional view taken along line 9A-9A in FIG. 8A.
Figure 9B:
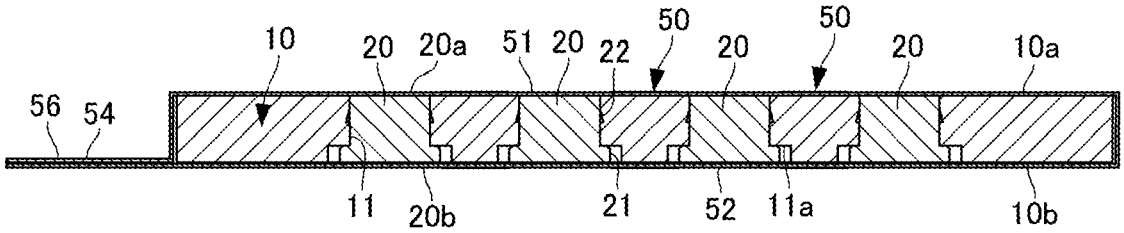
FIG. 9B is a cross-sectional view taken along line 9B-9B in FIG. 8A.
Figure 10:
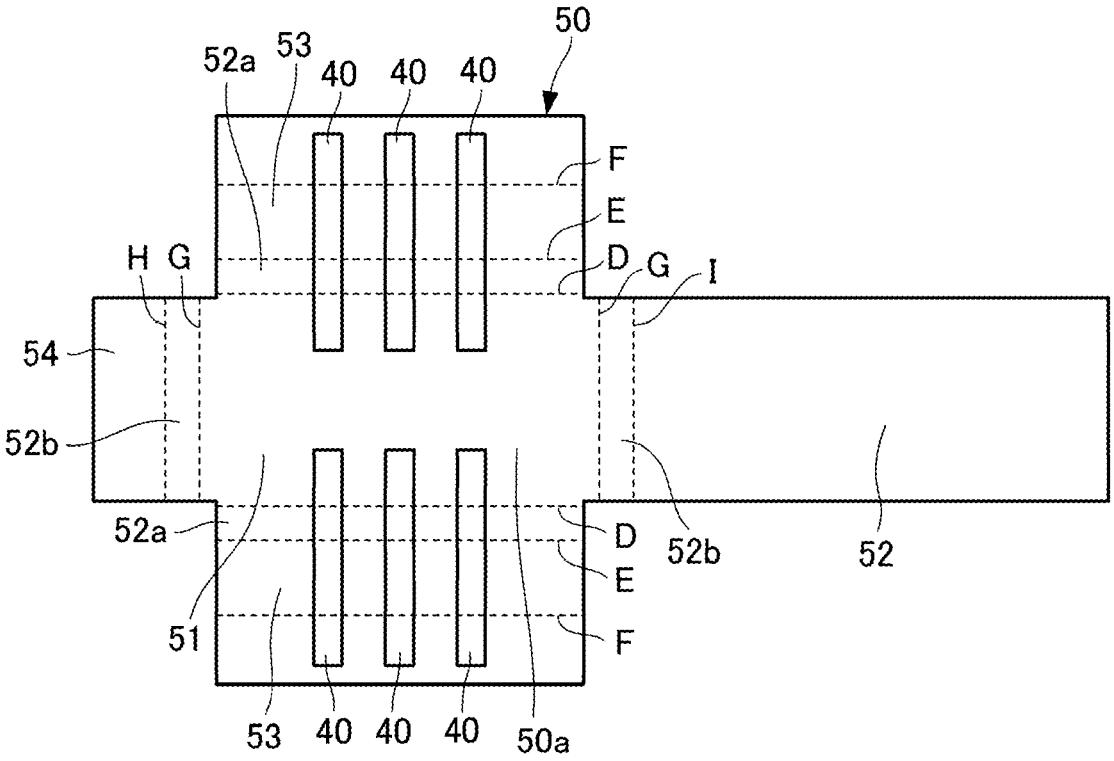
FIG. 10 is a plan view showing a sheet of the second embodiment in an unfolded state.

FIGS. 8 and 9 show a connector 2 of the second embodiment in which the sheet 50 is attached to the housing 10, and FIG. 10 shows the sheet 50 in an unfolded state.

As shown in FIG. 10, the sheet 50 of the second embodiment is formed in a generally cross shape. The sheet 50 is folded into a thin rectangular solid shape as shown in FIGS. 8A and 8B with broken lines D and G being used as right-angled mountain fold portions, broken lines E and H as right-angled valley fold portions, and broken lines F and I as bending portions at which the sheet 50 is folded back 180 degrees. The sheet 50 is attached to the housing 10 with the housing 10 being contained therein.

As shown in FIG. 10, the sheet 50 of the second embodiment includes: a front surface covering portion 51 for covering a front surface 10*a* of the housing 10; a rear surface covering portion 52 for covering a rear surface 10*b* of the housing 10; two longitudinal side surface covering portions 52*a* and two short-side side surface covering portions 52*b* for covering the side surfaces of the housing 10; two lateral flange-forming portions 53; and an end flange-forming portion 54.

As shown in FIG. 10, six strip-shaped contacts 40 are provided on a front surface 50*a* of the sheet 50. These contacts 40 are arranged in threes symmetrically in a vertical direction in FIG. 10 in two regions each extending from the front surface covering portion 51 to the lateral flange-forming portion 53. Each of the contacts 40 is provided to extend in the vertical direction in FIG. 10 while crossing, at a right angle, the mountain fold portion D, the valley fold portion E, and the bending portion F. Moreover, the contacts 40 are arranged at equally-spaced intervals in a horizontal direction in a central portion, in the horizontal direction, of an entire region of the front surface covering portion 51 and the lateral flange-forming portions 53.

As shown in FIGS. 8A and 8B, the sheet 50 attached to the housing 10 includes: a flange 55 on each side of the housing 10 in a plate width direction (the Y direction in FIGS. 8A and 8B); and a flange 56 at one end of the housing 10 in a longitudinal direction (the X direction in FIGS. 8A and 8B). The flange 55 is formed by folding back the lateral flange-forming portion 53 180 degrees along the bending portion F. The flange 56 is formed by overlapping the end flange-forming portion 54 and an end portion of the rear surface covering portion 52 with each other as shown in FIG. 9B.

In the state in which the sheet 50 is attached to the housing 10 while covering the housing 10 as shown in FIGS. 8A and 8B, each of the contacts 40 is provided to extend over a region from the front surface covering portion 51, through the side surface covering portion 52*a* and a front surface 55*a* of the flange 55, to a rear surface 55*b* of the flange opposite to the front surface 55*a*. In other words, each of the contacts 40 formed on the front surface 50*a* of the sheet 50 is provided on the front surface 10*a* side and the rear surface 10*b* side of the housing 10 by being folded at its intermediate portion along the bending portion F. In the present embodiment, a portion of the contact 40 provided in the front surface covering portion 51 for covering the front surface 10*a* of the housing 10 constitutes a front-side contact portion 40*a* to be in contact with a counterpart contact 94 of a counterpart connector 9. A portion of the contact 40 provided on the rear surface 55*b* of the flange 55 constitutes a rear-side contact portion 40*b* to be in contact with a conductive pattern of clothes 100.

Figure 11:
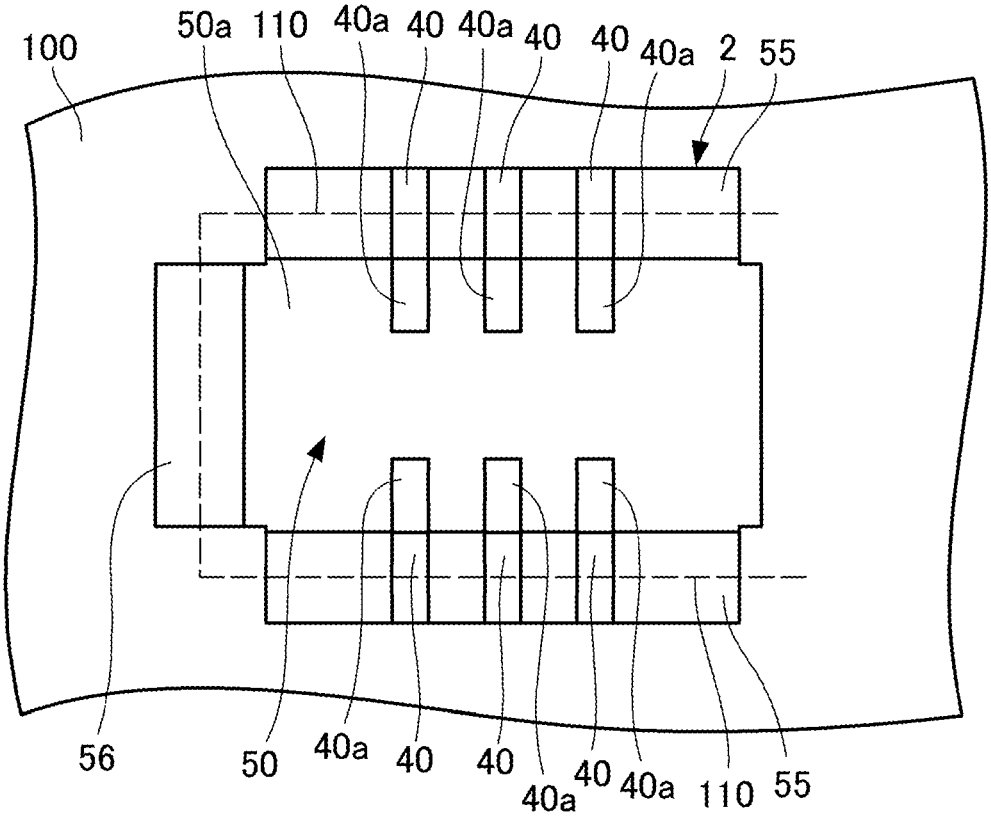
FIG. 11 is a view showing a state in which the connector of the second embodiment is attached to clothes.

As shown in FIG. 11, the connector 2 of the second embodiment is used with the flanges 55 and 56 of the sheet 50 being sewn onto the clothes 100 with an insulating sewing thread 110. The connector 2 is sewn onto the clothes 100 so that the rear-side contact portions 40*b* of the contacts 40 is in contact with the conductive pattern of the clothes 100.

Since approximately the entire surface of the housing 10 is covered with the front surface covering portion 51, the rear surface covering portion 52, and the side surface covering portions 52*a* and 52*b*, the connector 2 of the second embodiment can more reliably obtain effects such as protecting the housing 10 by the sheet 50 and preventing the housing 10 and the retention members 20 from dropping off.

Third Embodiment

The third embodiment will be described next.

The third embodiment differs from the aforementioned first and second embodiments in that a sheet 60 includes a housing recess 61 for a housing 10 and a flange 62 is provided circumferentially around the housing recess 61. The housing 10 and retention members 20 in the third embodiment are identical to those of the first and second embodiments. Therefore, the sheet 60 will be mainly described in the following description. Note that the same components as those of the first and second embodiments will be denoted by the same reference numerals in the reference drawings and the description thereof will be omitted as appropriate.

Figure 12A:
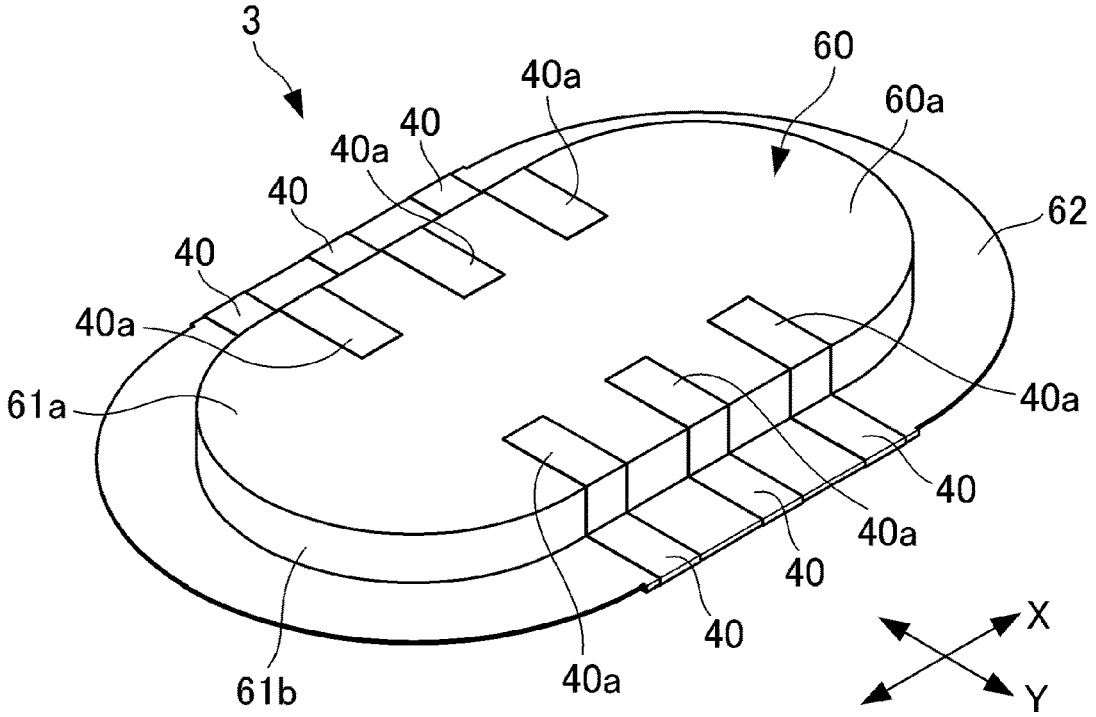
FIG. 12A is a perspective view showing a front surface side of a connector according to a third embodiment.
Figure 12B:
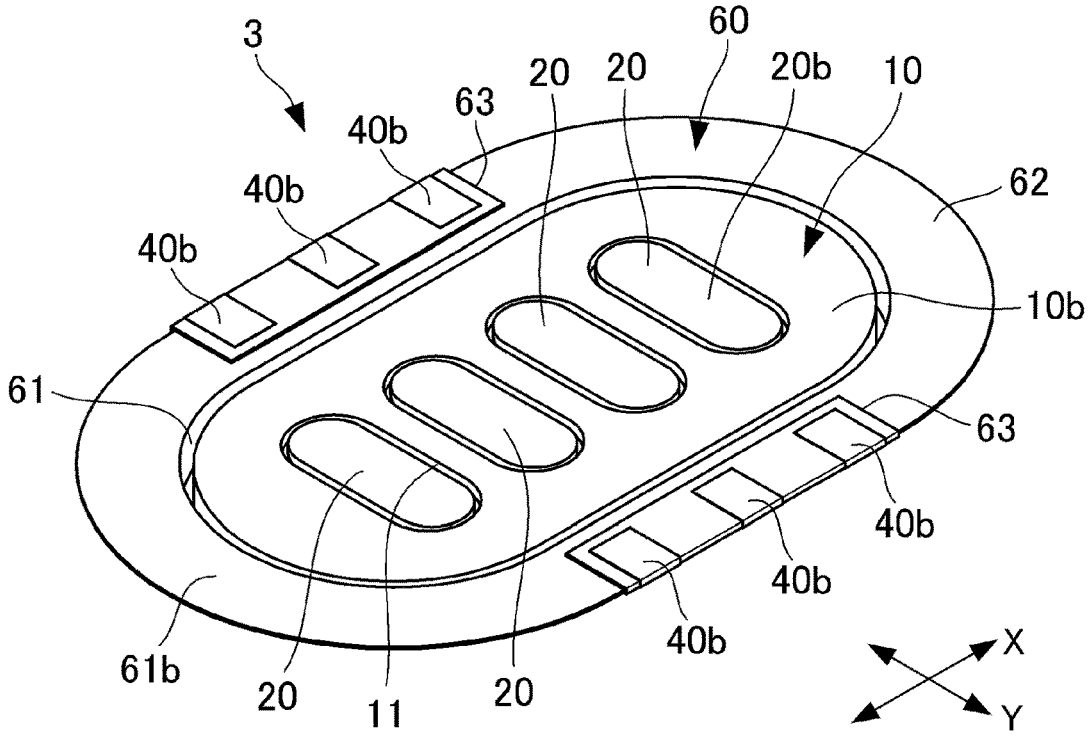
FIG. 12B is a perspective view showing a rear surface side of the connector according to the third embodiment.

FIG. 12 shows a connector 3 of the third embodiment. The sheet 60 of the third embodiment includes six strip-shaped contacts 40 on a front surface 60*a* thereof, and includes the housing recess 61 having the same shape as the housing 10 on a rear surface 60*b* side. The sheet 60 is attached to the housing 10 with the housing 10 being contained in the housing recess 61. The housing 10 is contained in the housing recess 61 with a front surface 10*a* thereof facing a bottom portion 61*a*.

The general shape of the sheet 60 according to the third embodiment is formed in a track shape similar to the housing 10, and the elliptical flange 62 with an approximately fixed width is formed around the housing recess 61. The housing recess 61 is formed by the bottom portion 61*a* and a side wall portion 61*b*. The flange 62 extends outward from an open edge of the side wall portion 61*b*.

Figure 13A:
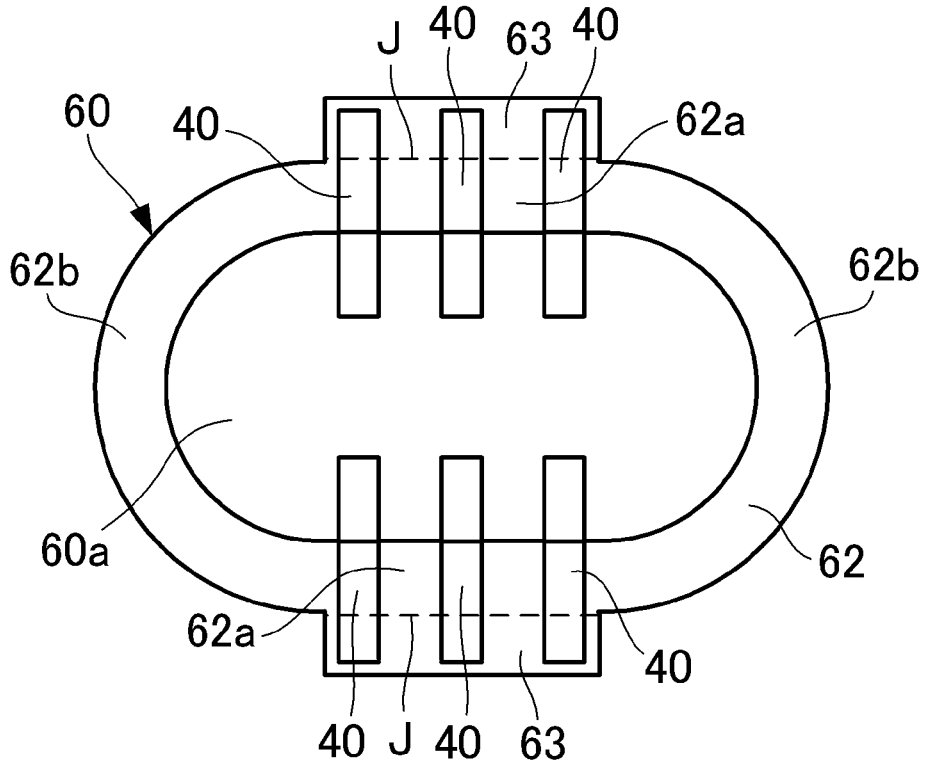
FIG. 13A is a perspective view showing a front surface side of a sheet according to the third embodiment.
Figure 13B:
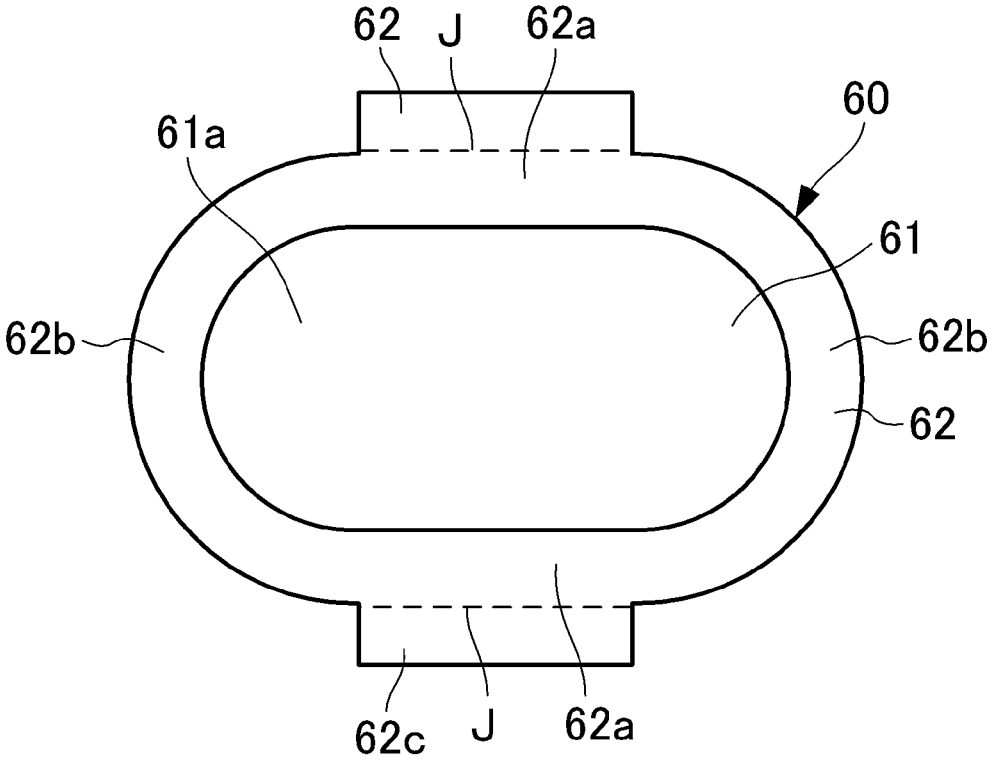
FIG. 13B is a view showing a rear surface side of the sheet according to the third embodiment.

As shown in FIGS. 13A and 13B, the flange 62 of the sheet 60 includes: straight portions 62*a* parallel to each other; and semicircular arc portions 62*b*, provided on the both sides of the straight portions 62*a*, connecting between the straight portions 62*a*. Provided external to the straight portions 62*a* of the flange 62 are rectangular protruding portions 63 disposed along the straight portions 62*a*. The protruding portion 63 is folded back 180 degrees toward the reverse side along a boundary J with the flange 62 so as to overlap the flange 62.

As shown in FIGS. 13A and 13B, the contacts 40 are provided in threes at equally-spaced intervals on each side of the sheet 60 in a width direction thereof, i.e., a direction perpendicular to the straight portions 62*a*. Each of the contacts 40 is provided to extend, in the width direction, over the bottom portion 61*a* and the side wall portion 61*b* of the housing recess 61, the flange 62, and the protruding portion 63 on the front surface 60*a* side of the sheet 60. In the sheet 60, the protruding portion 63 is folded back 180 degrees toward the reverse side along the boundary J with the flange 62 so as to overlap the flange 62. Thus, each of the contacts 40 is provided separately as a front-side contact portion 40*a* on the front surface 10*a* side of the housing 10, and a rear-side contact portion 40*b* on a rear surface 10*b* side of the housing 10.

Figure 14:
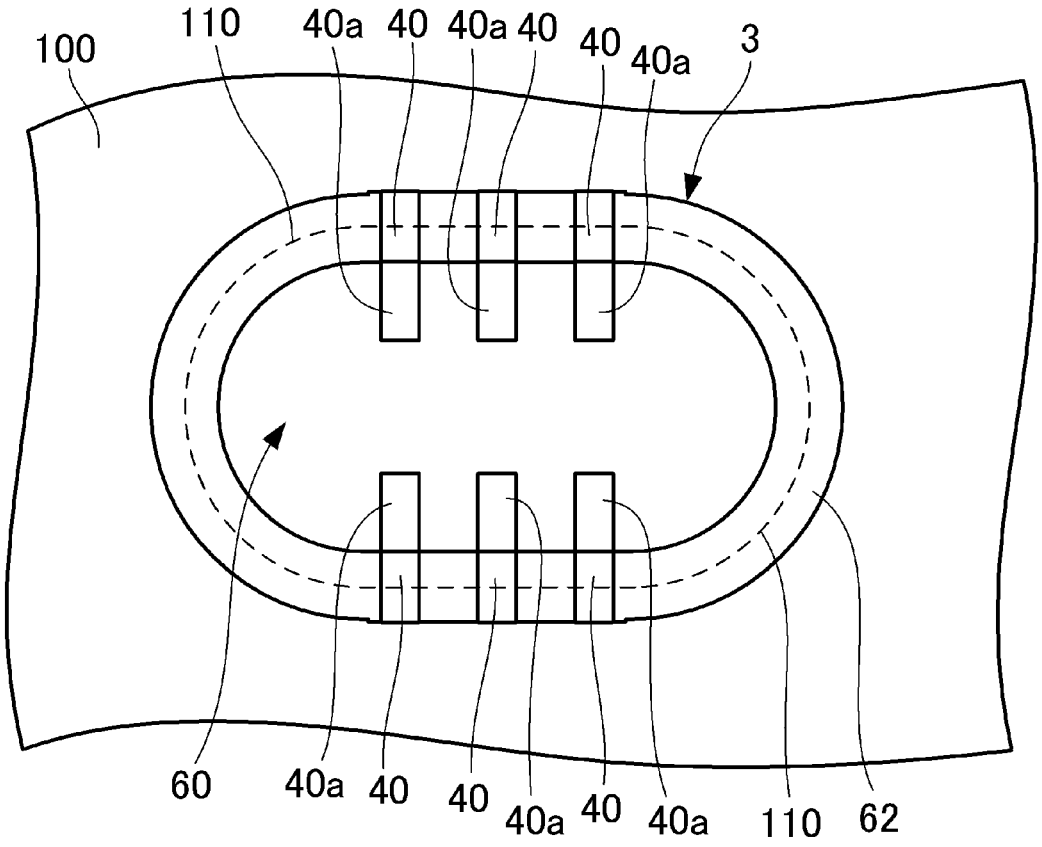
FIG. 14 is a view showing a state in which the connector according to the third embodiment is attached to clothes.

As shown in FIG. 14, the connector 3 of the third embodiment is used with the flange 62 of the sheet 60 being sewn onto clothes 100 with an insulating sewing thread 110. The connector 3 is sewn onto the clothes 100 so that the rear-side contact portions 40*b* of the contacts 40 is in contact with a conductive pattern of the clothes 100. The sewing with the sewing thread 110 is performed circumferentially in the flange 62.

Since the housing recess 61 for the housing 10 is provided in the sheet 60, the connector 3 of the third embodiment can facilitate the positioning of the housing 10 relative to the sheet 60. Consequently, the housing 10 can be easily attached to the sheet 60, thereby improving the productivity of the connector 3.

Moreover, since the connector 3 can be sewn onto the clothes 100 with the use of the flange 62 of the sheet 60 as a seam allowance, the connector 3 can be easily attached to the clothes 100. The sheet 60 of the third embodiment, in particular, includes the flange 62 provided circumferentially around the housing recess 61 for the housing 10. Thus, by sewing the entire circumferential length of the flange 62 onto the clothes 100, the housing 10 can be reliably prevented from dropping off, and a connection state with the conductive pattern of the clothes 100 can be made reliable and stable.

Fourth Embodiment

The forth embodiment will be described next.

A sheet 60B of the fourth embodiment is similar to the aforementioned sheet 60 of the third embodiment, but is different from the sheet 60 of the third embodiment in that no protruding portions 63 are provided and contacts 40 are provided only on a front surface 4*a* side of a connector 4. Therefore, the sheet 60B will be mainly described in the following description. Note that the same components as those of the third embodiment will be denoted by the same reference numerals in the reference drawings and the description thereof will be omitted as appropriate.

Figure 15A:
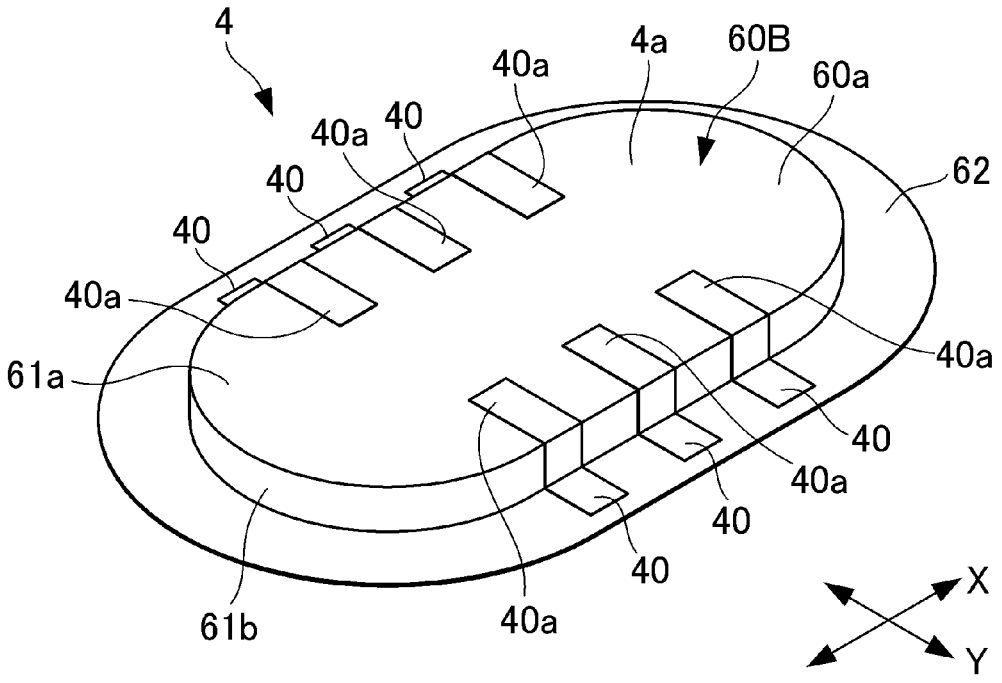
FIG. 15A is a perspective view showing a front surface side of a connector according to a fourth embodiment.
Figure 15B:
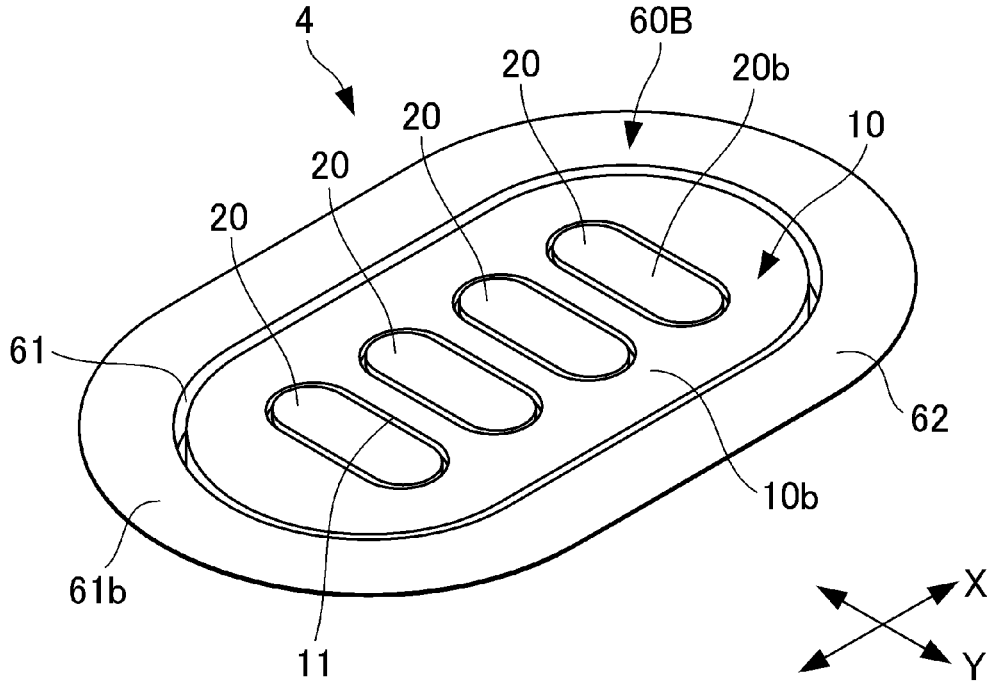
FIG. 15B is a perspective view showing a rear surface side of the connector according to the fourth embodiment.

As shown in FIGS. 15A and 15B, the sheet 60B of the connector 4 according to the fourth embodiment includes a flange 62 provided circumferentially around a housing recess 61 and includes no protruding portions 63 as in the third embodiment. Each of the contacts 40 is provided to extend, in a width direction of the sheet 60B, over a bottom portion 61*a* and a side wall portion 61*b* of the housing recess 61, and the flange 62 on a front surface of the sheet 60B.

Figure 16:
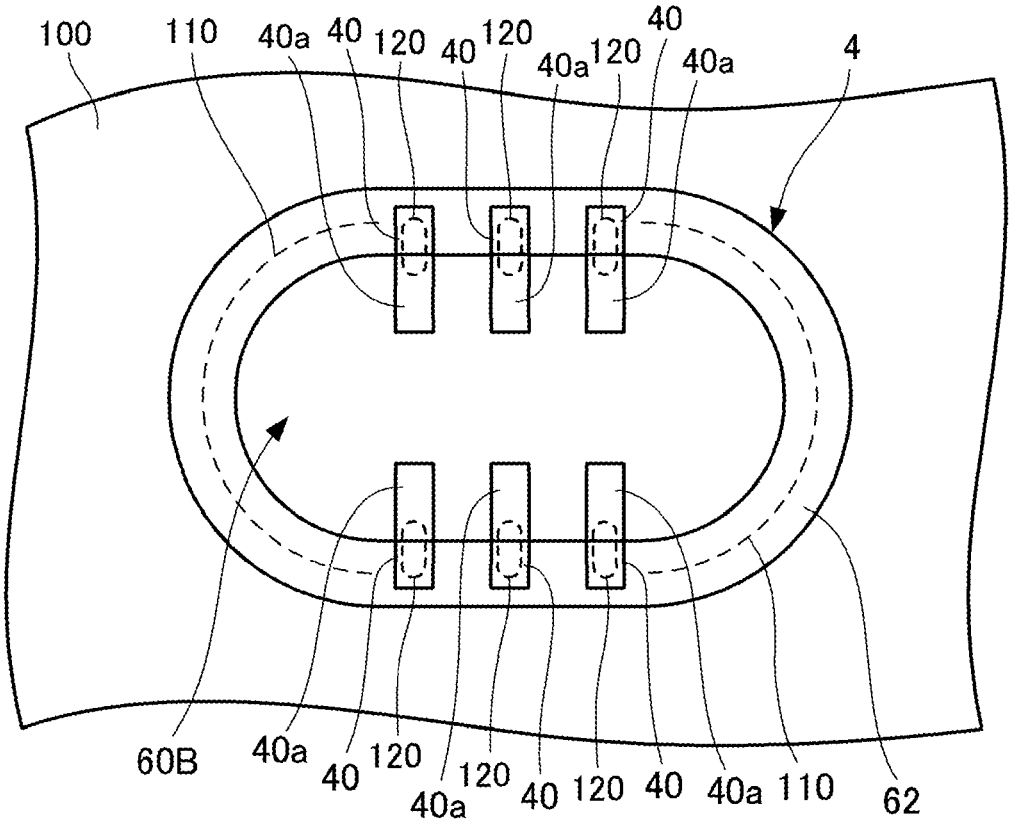
FIG. 16 is a view showing a state in which the connector according to the fourth embodiment is attached to clothes.

In the connector 4 of the fourth embodiment, six portions of the flange 62 where the contacts 40 are provided are each sewn onto clothes 100 with a conductive sewing thread 120, and the other portion of the flange 62 is sewn onto the clothes 100 with an insulating sewing thread 110 as shown in FIG. 16. The sewing thread 120 corresponds to an exemplary attaching material of the present invention. The connector 4 is attached so that the contacts 40 are electrically connected to a conductive pattern of the clothes 100 via the conductive sewing thread 120.

As to the conductive sewing thread 120, a thread body may be made of a material having conductivity, or an insulating thread body may be covered with a conductive material. For example, a stainless steel fiber, or a thread structured by winding elongated copper foil around a polyester thread body may be used as the sewing thread 120.

The connector 4 of the fourth embodiment reliably allows the contacts 40 and the conductive pattern of the clothes 100 to be electrically connected to each other by sewing the both with the conductive sewing thread 120. Moreover, since the connector 4 can be sewn onto the clothes 100 with the use of the flange 62 of the sheet 60B as a seam allowance, the connector 4 can be easily attached to the clothes 100.

INDUSTRIAL APPLICABILITY

The present invention is useful as the connector and the connector assembly capable of being attached to a freely bendable object such as clothes when used.

REFERENCE SIGNS LIST

1, 2, 3, 4 connector
8 connector assembly
9 counterpart connector
10 housing
10*a* front surface of housing (one of plate surfaces)
10*b* rear surface of housing (the other one of plate surfaces)
20 retention member
30, 50, 60, 60B sheet
30*a*, 50*a*, 60*a* front surface of sheet
34, 55, 56, 62 flange
40 contact
61 housing recess
91 counterpart housing
92 counterpart retention member
94 counterpart contact
100 clothes (object)
110, 120 sewing thread

The invention claimed is:

1. A connector attached to a predetermined object and capable of being detachably fitted into a counterpart connector, comprising:
- a plate-shaped housing made of an insulating material having bendability;
- a retention member provided in the housing so as to allow for the bendability, the retention member being configured to retain a fit state with the counterpart connector;
- a flexible sheet attached to the housing in such a manner as to cover at least a part of the retention member and attached to the object by attaching material; and
- a conductive contact provided on the sheet.

2. The connector according to claim 1, wherein the contact is formed in a strip shape as a coating layer of a conductive ink on a front surface of the sheet, and
- the contact is provided on one of plate surfaces of the housing and the other one of the plate surfaces by folding the sheet with an intermediate portion of the contact being used as a bending portion in such a manner that rear surface portions, opposite to the front surface, face each other.

3. The connector according to claim 1, wherein the sheet is attached to the housing while the sheet is folded in such a manner as to enwrap the housing.

4. The connector according to claim 1, wherein the sheet includes a housing recess configured to contain the housing therein, and the sheet is attached to the housing with the housing being contained in the housing recess.

5. The connector according to claim 1, wherein the sheet includes a flange around the housing when the sheet is attached to the housing, at least a part of the contact is provided in the flange, and the sheet is attached to the object via the flange by means of the attaching material.

6. The connector according to claim 1, wherein the attaching material is a sewing thread.

7. A connector assembly comprising:

the connector according to claim 1; and a counterpart connector into which the connector is fitted, wherein the counterpart connector includes: a counterpart housing; a conductive counterpart contact provided in the counterpart housing; and a counterpart retention member provided in the counterpart housing and including a magnet, and upon a fit between the connector and the counterpart connector, the contact and the counterpart contact are in contact with each other, and the retention member and the counterpart retention member are attracted to each other by magnetic force, thereby retaining the fit state.

* * * * *